US010960557B2

(12) United States Patent
Krauss et al.

(10) Patent No.: US 10,960,557 B2
(45) Date of Patent: Mar. 30, 2021

(54) ELECTRIC SHAVER WITH FOUR JOINT LINKAGE

(71) Applicant: Braun GmbH, Kronberg (DE)

(72) Inventors: Joachim Krauss, Seeheim-Jugenheim (DE); Uwe Fischer, Darmstadt (DE); Roman Roeder, Oberursel (DE); Andreas Erndt, Kelkheim (DE); Detlef Gleich, Friedrichsdorf (DE); Uwe Ludaescher, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/715,046

(22) Filed: Sep. 25, 2017

(65) Prior Publication Data

US 2018/0085940 A1 Mar. 29, 2018

(30) Foreign Application Priority Data

Sep. 28, 2016 (EP) ..... 16191156
Sep. 25, 2017 (EP) ..... 17192891

(51) Int. Cl.
*B26B 19/04* (2006.01)
*B26B 19/28* (2006.01)
(Continued)

(52) U.S. Cl.
CPC ..... *B26B 19/048* (2013.01); *B26B 19/042* (2013.01); *B26B 19/046* (2013.01);
(Continued)

(58) Field of Classification Search
CPC ... B26B 19/048; B26B 19/386; B26B 19/063; B26B 19/042; B26B 19/046; B26B 19/28; B26B 19/284; B26B 19/384
See application file for complete search history.

(56) References Cited

U.S. PATENT DOCUMENTS 3,618,209 A * 11/1971 Battagalli ..... B26B 19/384 30/43.3
3,748,371 A 7/1973 Krook et al.
(Continued)

FOREIGN PATENT DOCUMENTS

AT 409604 B 9/2002
CN 1268083 A 9/2000
(Continued)

OTHER PUBLICATIONS

Jonathan G. Riley; Restriction Requirement; U.S. Appl. No. 15/715,023; dated Oct. 18, 2018; United States Patent and Trademark Office; Alexandria, Virginia.
(Continued)

*Primary Examiner* — Jason Daniel Prone
*Assistant Examiner* — Samuel A Davies
(74) *Attorney, Agent, or Firm* — Kevin C. Johnson; Gerd Zetterer

(57) ABSTRACT

Electric shaver provided with a handle and a shaver head including at least one drivable cutter element, wherein said shaver head is connected to said handle by means of a support structure providing for a swivel and/or tilting axis about which said shaver head may swivel or tilt relative to said handle, wherein said support structure includes a pair of link arms forming a four-joint linkage with each link arm having a head joint connected to a shaver head part and a handle joint connected to the handle or a base part connected thereto.

17 Claims, 7 Drawing Sheets

(51) Int. Cl.
*B26B 19/38* (2006.01)
*B26B 19/06* (2006.01)

(52) U.S. Cl.
CPC ..... *B26B 19/063* (2013.01); *B26B 19/28* (2013.01); *B26B 19/284* (2013.01); *B26B 19/384* (2013.01); *B26B 19/386* (2013.01)

(56) References Cited

U.S. PATENT DOCUMENTS

| | | | | |
|---|---|---|---|---|
| 5,231,760 | A * | 8/1993 | Koster | B26B 19/28 30/43 |
| 5,704,126 | A | 1/1998 | Franke et al. | |
| 6,226,871 | B1 | 5/2001 | Eichhorn et al. | |
| 6,357,118 | B1 * | 3/2002 | Eichhorn | B26B 19/048 30/43.92 |
| 6,441,517 | B1 * | 8/2002 | Brum | B26B 19/28 310/30 |
| 7,841,090 | B2 | 11/2010 | Eichhorn et al. | |
| 2005/0028371 | A1 * | 2/2005 | Kakimoto | B26B 19/063 30/43.92 |
| 2006/0085985 | A1 | 4/2006 | Oh | |
| 2006/0107530 | A1 * | 5/2006 | Shimizu | B26B 19/046 30/43.92 |
| 2006/0283019 | A1 | 12/2006 | Oh | |
| 2008/0034591 | A1 * | 2/2008 | Fung | B26B 19/02 30/43.92 |
| 2009/0025229 | A1 | 1/2009 | Kappes et al. | |
| 2010/0175264 | A1 | 7/2010 | Shimizu et al. | |
| 2011/0094107 | A1 | 4/2011 | Ring et al. | |
| 2018/0085939 | A1 | 3/2018 | Krauss et al. | |

FOREIGN PATENT DOCUMENTS

| | | | |
|---|---|---|---|
| CN | 1727132 | A | 2/2006 |
| CN | 101052499 | A | 10/2007 |
| CN | 102076469 | A | 5/2011 |
| DE | 2017775 | | 12/1970 |
| DE | 19736776 | A1 | 3/1999 |
| DE | 102006010323 | | 9/2007 |
| EP | 1621299 | | 2/2006 |
| EP | 1547735 | B1 | 6/2006 |
| EP | 2435218 | B1 | 3/2014 |
| FR | 1391957 | B | 3/1965 |
| GB | 811207 | | 4/1959 |
| JP | H06-260 | A | 1/1994 |
| JP | H06261986 | A | 9/1994 |
| JP | H0866567 | A | 3/1996 |
| JP | 2001513414 | A | 9/2001 |
| JP | 2011526168 | A | 10/2011 |
| JP | 2016077464 | A | 5/2016 |
| KR | 20100007248 | U | 7/2010 |
| WO | 2010000352 | A2 | 1/2010 |
| WO | 2015158681 | A1 | 10/2015 |

OTHER PUBLICATIONS

Jonathan G. Riley; Office Action; U.S. Appl. No. 15/715,023; dated Mar. 21, 2019; United States Patent and Trademark Office; Alexandria, Virginia.
Jonathan G. Riley; Final Office Action; U.S. Appl. No. 15/715,023; dated Aug. 8, 2019; United States Patent and Trademark Office; Alexandria, Virginia.
Jonathan G. Riley; Office Action; U.S. Appl. No. 15/715,023; dated Nov. 29, 2019; United States Patent and Trademark Office; Alexandria, Virginia.
Delahoussaye, Ronald; ENSC 2123 CH16 Instant Center Theory, Jul. 11, 2012, available on Aug. 1, 2019, at: https://www.youtube.com/watch?v=7PeiNs6yuSc.
Rattenberger, B.; Extended European Search Report; European Application No. 17192891.4; dated Feb. 7, 2018; European Patent Office; Munich, Germany.
Rattenberger, B.; Extended European Search Report; European Application No. 16191156.5; dated Apr. 4. 2017; European Patent Office; Munich, Germany.
Rattenberger, B.; Priority Search Report; European Application No. 16191156.5; dated Mar. 23, 2017; European Patent Office; Munich, Germany.
Search Report; Chinese Application No. 201780059922.1; dated Mar. 26, 2020; China National Intellectual Property Administration; Beijing, China.
Office Action; Chinese Application No. 201780059922.1; dated Apr. 1, 2020; China National Intellectual Property Administration; Beijing, China.
Search Report; Chinese Application No. 201780059912.8; dated May 20, 2020; China National Intellectual Property Administration; Beijing, China.
Office Action; Chinese Application No. 201780059912.8; dated May 28, 2020; China National Intellectual Property Administration; Beijing, China.
Ogawa, Makoto; Notice of Reasons for Refusal; Japanese Patent Application No. 2019-516676; dated May 29, 2020; Japanese Patent Office; Tokyo, Japan.
Yamamura, Kazuhito; Notice of Reasons for Refusal; Japanese Patent Application No. 2019-515922; dated Jun. 12, 2020; Japanese Patent Office; Tokyo, Japan.
Rattenberger, B.; International Search Report and Written Opinion; International Application No. PCT/IB2017/055850; dated Jan. 16, 2018; European Patent Office; Riswijk, Netherlands.
Rattenberger, B.; International Search Report and Written Opinion; International Application No. PCT/IB2017/055849; dated Jan. 19, 2018; European Patent Office; Riswijk, Netherlands.

* cited by examiner

ELECTRIC SHAVER WITH FOUR JOINT LINKAGE

FIELD OF THE INVENTION

The present invention relates to an electric shaver having a shaver head that may self-adapt its angular position to the skin contour. More particularly, the present invention relates to an electric shaver comprising a handle and a shaver head including at least one drivable cutter element, wherein said shaver head is connected to said handle by means of a support structure providing for a swivel axis and a tilting axis about which said shaver head may swivel and tilt relative to said handle, wherein said support structure includes a pair of link arms forming a four-joint linkage with each link arm having a head joint connected to a shaver head part and a handle joint connected to the handle or a base part connected thereto.

BACKGROUND OF THE INVENTION

Electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or a magnetic-type linear motor, wherein the drive unit may include a drive train having elements such as an elongated drive transmitter for transmitting the driving motion of the motor to the cutter element, wherein said motor may be received within the handle portion of the shaver or in the alternative, in the shaver head thereof.

Irrespective of the architecture of the drive unit and the drive train, the cutter elements, in addition to the aforementioned cutting motion, may be movable in other directions so as to self-adapt to the contour of the skin to be shaved. For example, the cutter elements may be part of a shaver head that is slewable about one or more axes relative to the handle of the shaver, wherein the support structure connecting the shaver head to the handle may allow the shaver head to swivel about a swivel axis extending substantially parallel to the elongated cutter elements and/or the reciprocating axis thereof. In addition or in the alternative, the supporting structure may allow the shaver head to tilt about a tilting axis extending transverse to the longitudinal axis of the handle and transverse to the elongated cutter elements and/or the reciprocating axis thereof. In addition to or in the alternative to such shaver head movements, the cutter elements may dive into the shaver head so as to adjust the position relative to the skin contour to be shaved.

The support structure connecting the shaver head to the handle may have different configurations so as to allow for the aforementioned swiveling and/or tilting movements and to avoid collisions with the drive train extending from the drive unit to the cutter element. For example, the support structure may include a so-called four-joint linkage formed by a pair of link arms which are, on the one hand, pivotably mounted to the handle and, on the other hand, pivotably mounted to a shaver head part such as a shaver head frame, wherein the pivotable joints connecting the link arms to the handle and the shaver head, respectively, may define pivot axes parallel to each other and parallel to the tilting or swiveling axis defined by such four-joint linkage. Due to slewing or rotating movements of the link arms, the shaver head may tilt or swivel to adjust its rotatory position to better follow the skin contour.

For example, prior art reference US 2010/0175264 A1 shows such four-joint linkage of the shaver head to the handle, wherein the link arms are arranged in a sort of pendulum or hanging arrangement. An interposer part attached to the handle includes two poles projecting upwards into the shaver head, wherein the link arms are pivotably attached to the top end portions of such poles to extend or hang downwards back towards to the handle. The lower end portions of such hanging link arms are pivotably connected to a shaver head frame.

A similar four-joint linkage of a shaver head to the shaver's handle with link arms "hanging downwards" towards the handle is known from EP 1621299 A1, wherein the cutter elements of such shaver head are driven by a motor received within said shaver head. Due to such motor arrangement inside the shaver head, the entire shaver is no longer balanced, but top heavy in terms of weight distribution. Furthermore, due to the space required for the motor in the shaver head, it is rather difficult to position a second pivoting axis, i.e. a tilting axis and a swivel axis allowing for multi-axial movements of the shaver head relative to the handle.

A similar support structure movably connecting the shaver head of an electric shaver to the handle thereof is shown by reference JP 2016-77464 A also showing a four-joint linkage including a pair of hanging link arms.

Another support structure allowing for swiveling and tilting of the shaver head of an electric shaver about swiveling and tilting axes is shown by EP 2 435 218 B1 suggesting a cardanic support structure including a shaver head frame pivotably mounted to a cradle-like handle part and, on the other hand, pivotably supporting a cutter frame on which the cutter element is supported.

Furthermore, AT 409604 B shows an electric shaver having cutter elements which may, in addition to the oscillating cutting movements, pivot about an axis perpendicular to the shaver's longitudinal axis and the axis of oscillation of the cutter element so as to allow for adjustment of the cutter element position to the skin to be shaved, and rotatorily oscillate about an axis parallel to the longitudinal axis of the shaver housing. The transmission train connecting the drive motor to the cutter elements includes a coupling structure rotatorily oscillating about a pivot axis parallel to the shaver housing's longitudinal axis.

US 2009/0025229 A1 discloses a drive unit for the cutter elements of an electric shaver, wherein the drive unit includes transmitter pins extending from the shaver housing towards the shaver head, wherein the oscillating driving movements of said transmitter pins are applied onto the cutter elements via an oscillatory bridge supported for oscillatory reciprocation in the shaver head, wherein said oscillatory bridge includes yielding coupling arms so as to allow for adjusting movements of the cutter elements. A similar transmission architecture is known from U.S. Pat. No. 7,841,090 B2.

Further electric shavers allowing for adapting movements of the cutter elements are known from U.S. Pat. No. 3,748,371 B, FR 1391957 A, GB 811,207 B and U.S. Pat. No. 5,704,126 B.

WO 2010/000352 A1 shows a shaver having a shaver head connected to the handle by means of a four joint linkage having a pair of link arms. The shaver's cutter elements are driven by a motor via a rocker bar rotated by said motor about an axis transverse to the rocker bar and transverse to the shaver's longitudinal axis, wherein said motor is arranged in the shaver head or at the top of the handle between said pair of link arms. Due to such arrangement of the drive unit, the entire shaver is no longer balanced, but top-heavy, thus impairing a comfortable handling of the shaver. Additionally, the shaver head becomes rather bulky when the motor is in the head what makes it sometimes difficult to shave smaller skin portions such as the face portion between the nose and the lips, and furthermore, the kinematics of the four joint linkage is restricted when the motor is arranged at the top of the handle between the link arms. Furthermore, driving efficiency is restricted due to bending of the rocker arms.

SUMMARY OF THE INVENTION

It is an objective underlying the present invention to provide for an improved electric shaver avoiding at least one of the disadvantages of the prior art and/or further developing the existing solutions. A more particular objective underlying the invention is to allow the shaver head self-adjusting of its position relative to the handle without restrictions to the drive train and without restrictions to the support structure's kinematics due to collisions with the drive unit.

A further objective underlying the invention is to allow for an easy, well-balanced handling of the shaver with better self-adaption of the angular position of the shaver head to the skin contour to be shaved, including a better responsiveness of self-adjusting swivel and tilt movements of the shaver head to changing skin contours when moving the shaver head along the skin contour to be shaved.

A still further objective underlying the invention is to achieve a highly efficient driving of the shaver's cutter elements as well as self-adjustment of the shaver head to the skin contour to be shaved with less pressure applied to the functional shaver head surface contacting the skin contour and/or a quicker readjustment of the shaver head into its neutral position with less restoring forces.

To achieve at least one of the aforementioned objectives, the link arms, in particular the length of the link arms and the distances between the head joints and handle joints thereof, may be configured such that a trajectory along which a virtual center point of the shaver head moves when rotating or tilting the shaver head relative to the handle, has a double pitch roof-like configuration comprising two trajectory branches diverging from each other towards the handle. Said virtual center point of the shaver head can be considered to be a point fixed with the shaver head part connected to the head joints of the link arms and positioned in the region of the center of the cutter unit and thus, adjacent to the tilting and swiveling axes. The virtual center point is no point of the cutter element itself, as such cutter element executes additional reciprocating movements, whereas said virtual center point executes only the rotatory movements of the shaver head frame under control of the four-point linkage.

In other words, the four-joint linkage may be configured such that the center of the cutter element dives towards the handle when the shaver head is rotated or tilted. Such trajectory of a point of the shaver head lying in the center of the cutter element allows for a natural feeling in handling the shaver and in addition allows for easy return of the shaver head to its neutral position. More particularly, the aforementioned double pitch roof-like configuration of the trajectory may reduce the frictional resistance between the cutter element and the shear foil when the shaver head is leaving its neutral position, since due to the aforementioned configuration of the trajectory the rotation of the shaver head relative to the handle causes no or only very small movements of the cutter element relative to the shear foil so that there is less or no resistance against rotation of the shaver head caused by the frictional resistance of the cutter element relative to the shear foil.

Said trajectory may have a rather narrow configuration with an extension limited to a central section defined by the neighborhood of a plane containing the handle's longitudinal axis. More particularly, the aforementioned two branches of the trajectory may extend from a peak point of the trajectory rather steeply and/or in a direction only slightly inclined to said central plane containing the longitudinal handle axis. For example, the trajectory may be limited to a central portion of the shaver extending from said central plane containing the longitudinal handle axis by less than +/−25% or less than +/−10% of the entire extension of the shaver head in a direction perpendicular to said plane. Such narrow trajectory may improve stability of the shaver head against undesired tilting due to frictional forces and gives a well-set feeling of handling to the user.

According to a further aspect, said link arms may be configured such that a direction of a force acting onto a functional side of the shaver head to be contacted with the skin to be shaved for tilting said shaver head is substantially the same as the direction of a major component of a tilting movement of the shaver head at a point defined by a vertical axis perpendicular to the tilting axis and crossing said shaver head's functional side. In contrast, prior art link arms are usually configured such that during the tilting movement of the shaver head only a minor component of the movement, if at all, is directed towards the handle. As a consequence, the shaver head may also shift laterally sidewards with the major tilt movement component. The trajectory of such a known arrangement may comprise a loop which is different to the aforementioned double pitch roof-like configuration.

Basically, the electric motor could be accommodated inside the shaver head so as to follow at least one of the rotatory movements about said swivel and tilting axes. Such arrangement inside the shaver head shortens the length of the drive train and thus provides for direct transmission of forces and/or torques. However, so as to avoid a top-heavy weight distribution, the electric motor may be accommodated within the shaver housing forming the handle, wherein the drive transmitter connecting the motor to the cutter element includes a drive shaft extending from the handle into the shaver head, thus passing the support structure allowing the shaver head to tilt and/or swivel relative to the handle. More particularly, said motor may be received in said handle on a side of the handle joints opposite to the shaver head, wherein the four joint linkage's pivot axes defined by the handle joints and the head joints of the link arms extend transverse to said drive shaft on opposite sides thereof.

More particularly, said pair of link arms may be arranged in a standing configuration with the head joints of the link arms connecting to the shaver head part being further away from the handle than the handle joints of the link arms connecting to the handle or base part. When the motor is arranged inside the handle below the handle joints of the link arms so that the four point linkage is arranged between the shaver head and the motor and the shaft extending from the handle into the shaver head, an improved kinematics for the shaver head can be achieved with less restrictions to the arrangement and positioning of the link arms as well as a balanced handling of the shaver can be achieved. As the shaft, with its rotatory axis, extending substantially parallel to the handle's longitudinal axis or slightly inclined thereto, is a rather slim element not needing much space transverse to its rotatory axis, there is much space for the four-joint linkage, in particular in a central region of the shaver body, thereby allowing for desired kinematics of the shaver head's movable support structure. Nevertheless, the shaver is well balanced due to the motor's weight being in the handle. In addition, driving efficiency can be improved due to the shaft being a rather stiff transmitter subject to less bending than a rocker bar even when designed with small dimensions to save weight.

Contrary to a hanging or pendulum arrangement of the link arms where—when considering the shaver in an upright position with the shaver head above the handle—the upper ends of the link arms are connected to the handle and the hanging lower ends of the link arms are connected to the shaver head, such standing configuration provides for additional space that can be used for the drive train, and for a better kinematics of the shaver head support. As in such standing configuration—when considering the aforementioned upright position of the shaver—the lower end portions of the link arms are connected to the handle or base part and the upper end portions of the link arms are connected to the shaver head part, the handle or base part does not need to extend deeply into the shaver head to reach the upper ends of the link arms saving considerable space in the region of the shaver head, thus giving more freedom and space to the drive train extending through the shaver head.

Such drive shaft passing the support structure, in particular the aforementioned four-joint linkage, may extend in a central region of the handle and/or shaver head, wherein it may extend in between the aforementioned link arms of the four-joint linkage. In other words, the link arms may be positioned on opposite sides of the drive train and may sandwich the aforementioned drive shaft or elongated transmitter between them. In the alternative, the link arms can be provided on one side of the drive train or transmitter. For example, the link arms may be offset in the direction of the axis of rotation defined by the link arms so that the drive train passes the support structure on one side of the link arms. In addition or in the alternative, the link arms also could be offset relative to such transmitter in a direction perpendicular to the axis of rotation defined by the link arms.

So as to transform the rotatory oscillation of the drive shaft as mentioned before into a linear oscillation of the at least one cutter element, a crank arm may be attached to the shaft, wherein such crank arm may be positioned within the shaver head and/or may support at least one drive pin for driving the cutter element. For example, such drive pin may extend substantially parallel to the shaft and may be fixedly attached to the crank arm to extend eccentric with regard to the shaft axis. When the crank arm, in its neutral position, extends substantially perpendicular to the desired linear oscillation of the cutter element, such drive pin is moved along a curved path tangential to the desired cutter element oscillation and thus, executes a nearly linear oscillation.

Due to the aforementioned standing arrangement of the link arms of the four-joint linkage, there is enough space in the region of the shaver head for such transmitter structure, wherein the rotatorily oscillating shaft may extend between the link arms.

These and other advantages become more apparent from the following description giving reference to the drawings and possible examples.

DETAILED DESCRIPTION OF THE INVENTION

Figure 1:
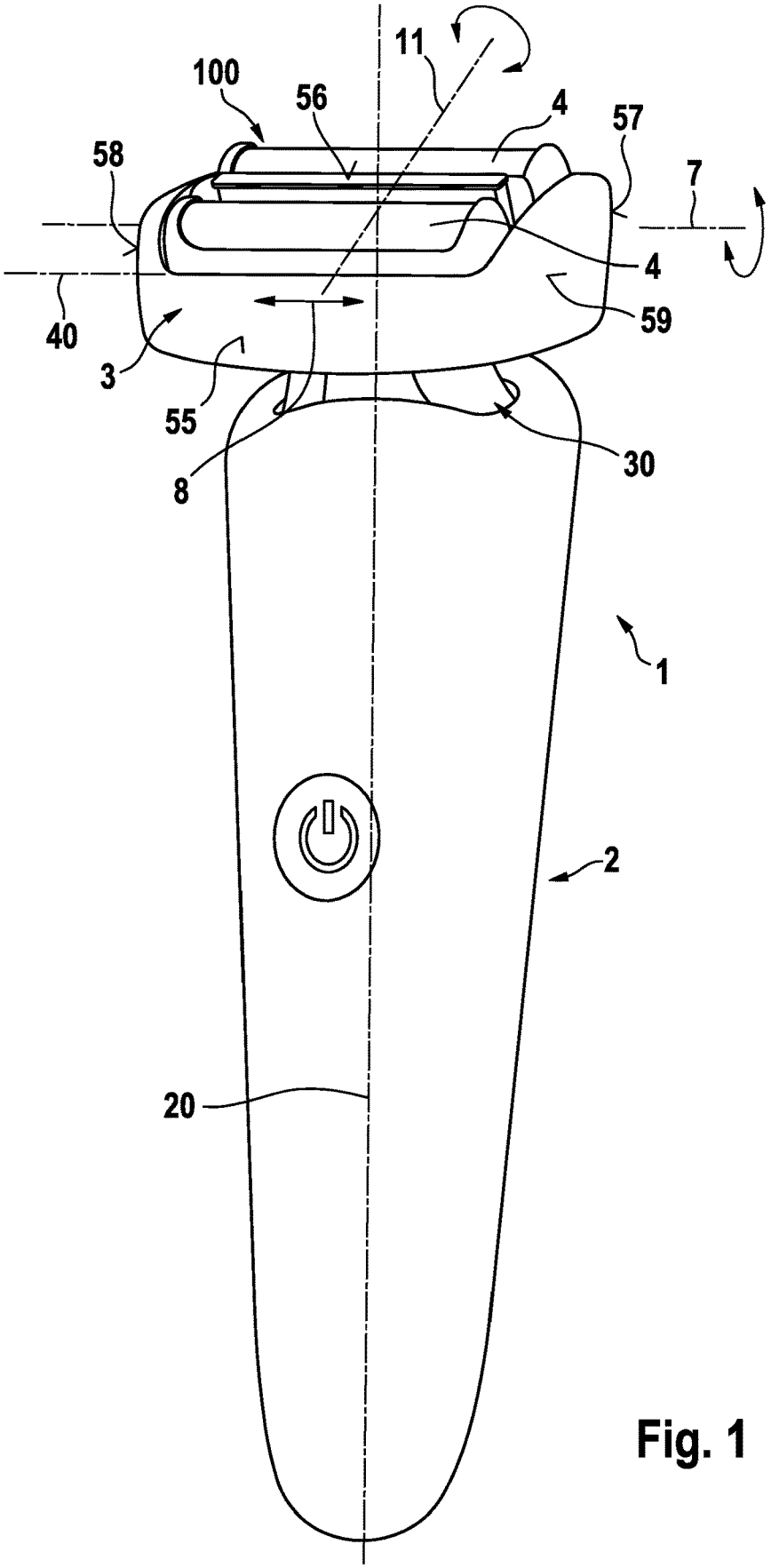
FIG. 1: a perspective view of an electric shaver with a self-adjusting shaver head, wherein the tilting and swiveling axes of the shaver head are shown in addition to the reciprocating drive axis and dive axis of the cutter element of the shaver head.

In order to achieve a responsive self-adjustment of the angular position of the cutter element to the skin and to avoid collisions between the drive train for driving the cutter element and the support structure, the four-joint linkage may include a pair of link arms arranged in an upright, standing configuration where the head joints of the link arms connected to the shaver head part are further away from the handle than the handle joints of the link arms connected to the handle or a base part connected to such handle. Such standing link arm configuration does not only give the drive train more space to extend in the region of the support structure, but also improves the shaver head kinematics to allow angular adjustment of the shaver head under less contact pressure from the skin to be shaved as the standing link arms are more willing to leave its position than hanging pendulum arms. In addition, such standing link arm configuration allows for an improved arrangement of the polhode or path along which the instantaneous center of rotation moves when rotatorily displacing the shaver head.

To achieve a well-balanced handling of the shaver and a high driving efficiency with less vibrations onto the shaver head and thus, less vibrations to the skin to be shaved, the electric motor may be accommodated within the shaver housing forming the handle, wherein the drive transmitter connecting the motor to the cutter element includes a drive shaft extending from the handle into the shaver head, thus passing the support structure allowing the shaver head to tilt and/or swivel relative to the handle. More particularly, said motor may be received in said handle on a side of the handle joints opposite to the shaver head, wherein the four joint linkage's pivot axes defined by the handle joints and the head joints of the link arms extend transverse to said drive shaft on opposite sides thereof.

As the shaft, with its rotatory axis, extending substantially parallel to the handle's longitudinal axis or slightly inclined thereto, is a rather slim element not needing much space transverse to its rotatory axis, there is much space for the four-joint linkage, in particular in a central region of the shaver body, thereby allowing for desired kinematics of the shaver head's movable support structure. Nevertheless, the shaver is well balanced due to the motor's weight being in the handle. In addition, driving efficiency can be improved due to the shaft being a rather stiff transmitter subject to less bending than a rocker bar even when designed with small dimensions to save weight.

Said shaft may be rotated by the motor in the handle in a rotatorily oscillating manner, i.e. back and forth about a limited angular range by means of, for example, a crank-type connection between the motor shaft and the drive shaft. So as to transform the rotatory oscillation of such drive shaft into a linear oscillation of the at least one cutter element, a crank arm may be attached to the shaft, wherein such crank arm may be positioned within the shaver head and/or may support at least one drive pin for driving the cutter element. For example, such drive pin may extend substantially parallel to the shaft and may be fixedly attached to the crank arm to extend eccentric with regard to the shaft axis. When the crank arm, in its neutral position, extends substantially perpendicular to the desired linear oscillation of the cutter element, such drive pin is moved along a curved path tangential to the desired cutter element oscillation and thus, executes a nearly linear oscillation.

To achieve high driving efficiency, said shaft may be rotatably, but otherwise fixedly supported by said handle so that the drive pin's longitudinal axis extends in a fixed orientation relative to said handle, wherein said drive pin's longitudinal axis may extend transverse to the reciprocating axis of said cutter element.

Due to the aforementioned standing arrangement of the link arms of the four-joint linkage, there is enough space in the region of the shaver head for such transmitter structure, wherein the rotatorily oscillating shaft may extend between the link arms.

In particular, the link arms of the four-joint linkage may be configured to define the instantaneous center of rotation moving along a path extending through and/or adjacent to said cutter element, wherein such path may have a curved shape which is convex towards a functional side of the shaver head to be contacted with the skin to be shaved. Said path along which the instantaneous center of rotation moves when the shaver head rotates relative to the handle under the control of the four-joint linkage, is sometimes referred to as polhode or centrode. In theory, such polhode defined by the link arms of the four-joint linkage may not only define a convex curve, but a closed circle. However, when considering the working range of the shaver head's movements and rotation relative to the handle, which working range is usually limited, said path of the instantaneous center of rotation may form the aforementioned convex curve which may have its summit or vertex positioned in the region of the cutter unit in the center thereof.

Due to such path of the instantaneous center of rotation extending very close to the functional surface of the cutter element, frictional forces due to sliding of the shaver along the skin to be shaved, do not cause undesired angular movements of the shaver head as such frictional forces have only short lever arms relative to the instantaneous center of rotation. On the other hand, pressure forces onto the functional surface of the shaver head which are mainly effective transverse to or perpendicular to such functional surface make the shaver head adjust its angular position to follow the contour of the skin.

The geometry of the link arms may be chosen such that the path of the instantaneous center of rotation is only slightly curved and/or has a flat or shallow contour so that the instantaneous center of rotation stays close to the cutter element, in particular the functional surface of such cutter element, what keeps the lever arm of frictional forces small when the shaver head is moved along the skin. For example, the link arms may be configured such that the entire polhode along which the instantaneous center of rotation moves when rotating the shaver head in its working range, i.e. between its maximum end positions, may extend within the shaver head. More particularly, at least a center section of the polhode, for example +/− one third of the polhode's length from the center thereof, may extend in an upper half of the shaver head, wherein such upper half means the half of the shaver head further away from the handle.

According to another aspect, said path of the instantaneous center of rotation may be adapted to extend in the region of or adjacent to the connection or joint of a drive pin of the drive train with the cutter element. At least a central portion of said path corresponding to the positions of the instantaneous center of rotation when the shaver head is in its neutral position or close thereto or only slightly rotated, may extend basically at the same height as the connecting joints of the drive train to the cutter elements or very close to a plane going through said connecting joints and perpendicular to the longitudinal handle axis. Due to the path of the instantaneous center of rotation being positioned close to the connecting joint of the drive train to the cutter element, the shaver head and thus the cutter elements remain substantially at the same height as the drive pins even when the shaver head is tilting or swiveling. Thus, such configuration of the path of the instantaneous center of rotation helps in providing for an easy connection between the drive train and the cutter element.

In order to achieve a higher stability of the shaver head in the region around its neutral position and/or to allow for easier further rotation after an initial rotation has been effected, the four-joint linkage may be configured to have the instantaneous center of rotation move further away from the diving side of the shaver head on which side the shaver head dives towards the handle when rotating about the axis defined by the four-point linkage. For example, when the shaver head is tilted or swiveled so that—when viewing the shaver head in the direction of the swivel or tilting axis—a right side end of the shaver head moves towards the handle, the instantaneous center of rotation moves towards the left side end of the shaver head. Due to such movement of the instantaneous center of rotation towards the non-diving, opposite end, the diving end of the shaver head may more easily further dive, as the surface portion of the functional surface of the shaver head contacting the skin where contacting forces or pressure have a lever arm with regard to the instantaneous center of rotation, increases. In other words, the lever arm of tilting forces increases due to the movement of the instantaneous center of rotation. For example, when the instantaneous center of rotation moves towards the left end side of the shaver head, the entire portion of the contact surface positioned on a right side of the instantaneous center of rotation has a lever arm causing the shaver head to further rotate about the instantaneous center of rotation. In other words, the contact pressure acting substantially perpendicular onto the functional surface causes a torque increasing with the degree of rotation of the shaver head as the instantaneous center of rotation moving towards the non-diving side increases the lever arm of such pressure force.

According to a further aspect, the link arms, in particular the length of the link arms and the distances between the head joints and handle joints of the link arms, may be configured such that a trajectory along which a virtual center point of the shaver head moves when rotating or tilting the shaver head, has a double pitch roof-like configuration comprising two trajectory branches diverging from each other towards the handle. The aforementioned virtual center point of the shaver head can be considered to be a point fixed with the shaver head part connected to the head joints of the link arms, and positioned in the region of the center of the cutter unit. The virtual center point is no point of the cutter element itself, as such cutter element executes additional reciprocating movements, whereas said virtual center point executes only the rotatory movements of the shaver head frame that is directly connected to the head joints of the link arms and thus, under control of the four-joint linkage.

In other words, the four-joint linkage may be configured such that the center of the cutter element dives towards the handle when the shaver head is rotated or tilted. Such trajectory of a point of the shaver head lying in the center of the cutter element allows for a natural feeling in handling the shaver and in addition allows for easy return of the shaver head to its neutral position. More particularly, the aforementioned double pitch roof-like configuration of the trajectory may reduce the frictional resistance between the cutter element and the shear foil when the shaver head is leaving its neutral position, since due to the aforementioned configuration of the trajectory the rotation of the shaver head relative to the handle causes no or only very small movements of the cutter element relative to the shear foil so that there is less or no resistance against rotation of the shaver head caused by the frictional resistance of the cutter element relative to the shear foil.

Said trajectory may have a rather narrow configuration with an extension limited to a central section defined by the neighborhood of a plane containing the handle's longitudinal axis. More particularly, the aforementioned two branches of the trajectory may extend from a peak point of the trajectory rather steeply and/or in a direction only slightly inclined to said central plane containing the longitudinal handle axis. For example, the trajectory may be limited to a central portion of the shaver extending from said central plane containing the longitudinal handle axis by less than +/−25% or less than +/−10% of the entire extension of the shaver head in a direction perpendicular to said plane. Such narrow trajectory may improve stability of the shaver head against undesired tilting due to frictional forces and gives a well-set feeling of handling to the user.

The four-point linkage may be provided to allow for tilting of the shaver head about a tilting axis that extends substantially perpendicular to the longitudinal axis of the handle and substantially perpendicular to a main axis of the shaver head, wherein such main axis of the shaver head may extend parallel to the longer side surfaces of the shaver head and/or parallel to the reciprocating axis of the cutter element and/or parallel to the longitudinal axis of the elongated cutter element itself. For example, when the shaver head has a substantially—roughly speaking—rectangular block-like shape with a pair of larger side surfaces neighboring the functional surface and a pair of smaller side surfaces neighboring the functional surface and the larger side surfaces, the aforementioned main axis may extend parallel to the larger side surfaces and the functional surface. Having defined the main axis of the shaver head in such way, the aforementioned tilting axis may be defined to extend substantially perpendicular or transverse to a plane defined by the handle's longitudinal axis and said main axis of the shaver head.

In the alternative or in addition, the aforementioned four-joint linkage also may be provided to define a swivel axis for the shaver head, which swivel axis extends substantially perpendicular to the handle's longitudinal axis and parallel to the aforementioned main axis of the shaver head.

Basically, there may be two four-joint linkages, one of which allowing for tilting of the shaver head and the other one allowing for swiveling of the shaver head about the aforementioned tilting and swiveling axes. In the alternative, however, according to an aspect, there may be provided a four-joint linkage of the aforementioned type for allowing tilting of the shaver head about the aforementioned tilting axis, whereas swiveling of the shaver head is allowed by means of a pivot axis support which may have a shaft-like axis rotatably received within a hole-like recess to define a fixed pivot axis.

The combination of the tilting support and the swiveling support may be chosen in different ways. According to an aspect, the four-joint linkage allowing for tilting of the shaver head may support a shaver head part such as a shaver head frame that may tilt relative to the handle about the tilt axis defined by the four-joint linkage and the pair of link arms thereof, wherein such tiltable shaver head part pivotably supports a further shaver head part such as a cutter element support part which may swivel about the swivel axis defined by such pivot bearing. In other words, the swivel support or swivel bearing is tiltably supported by the four-joint linkage.

In the alternative, it also would be possible to have the base part to which the link arms of the four-joint linkage are connected with their handle joints, pivotably supported relative to the handle so that said base part may swivel about the swivel axis defined by such pivot bearing. In such configuration, the four-joint linkage allowing for tilting movements of the shaver head may swivel relative to the handle.

The axis of rotation defined by the four-joint linkage—in particular the aforementioned tilting axis—substantially extends in parallel with the pivot axes of the link arms and the head/handle joints thereof. In particular, the head joints and handle joints of the link arms may be pivotably connected to the shaver head part and the handle or base part thereof, wherein all pivot axes defined by such head joints and handle joints may extend substantially parallel to each other and/or substantially perpendicular to the longitudinal axis of the elongated link arms.

When the four-joint linkage defines a tilting axis as mentioned before, such tilting axis does not necessarily extend exactly perpendicular to the longitudinal axis of the handle, but may be slightly inclined at an acute angle to the longitudinal axis of the handle. For example, such tilting axis may extend at an angle ranging from 75° to 89° relative to the longitudinal axis of the handle, wherein, however, it is also possible to have an exactly perpendicular arrangement with the tilting axis extending at an angle of 90° relative to the longitudinal axis of the handle.

Irrespective of the inclination of the tilting axis relative to the longitudinal axis of the handle, the link arms of the four-joint linkage providing for such tilting axis for the shaver head may be arranged in different positions and/or orientations. For example, the link arms may be positioned in a plane offset relative to the longitudinal axis of the handle and/or a center plane containing such longitudinal axis of the handle and/or relative to a drive train, wherein such offset from the longitudinal axis may be given in the direction of the tilting axis. In addition or in the alternative to such linear offset, the link arms may be arranged to have an angular offset, in particular they may be arranged in a common plane slightly inclined to the longitudinal axis of the handle, in particular when the tilting axis is also inclined to the longitudinal axis of the handle.

When the shaver head is supported for swiveling about a swivel axis and tilting about a tilting axis, the support structure may be configured to have the swivel axis and the tilting axis positioned closely to each other and/or close to the functional surface of the shaver head and/or close to the cutter element. In particular, the swivel axis may be defined by the support structure to extend through the cutter element and/or adjacent to the functional surface of the cutter element so that frictional surfaces transverse to the swivel axis—when moving the functional surface of the cutter head along the skin to be shaved—have no or no significant or only small lever arms relative to such swivel axis so that such frictional forces do not cause undesired swiveling of the shaver head. Such swivel axis may be defined by a pivot bearing as mentioned before what keeps the swivel axis in the desired position relative to the cutter element.

Furthermore, when the tilting axis is defined by a four-joint linkage as mentioned before, the four-joint linkage may be configured such that the instantaneous center of rotation is kept close to the swivel axis. In particular, the polhode along which the instantaneous center of rotation may move, may extend through and/or close to the swivel axis. According to an aspect, such polhode may completely extend in a hemisphere extending from said swivel axis of the shaver head towards the handle or in other words on the handle side of the swivel axis. When considering the shaver in an upright position with the shaver head above the handle, the polhode of the instantaneous center of tilting may extend below the swivel axis, in particular with a top portion of the polhode positioned close to the swivel axis and/or through the swivel axis.

For example, the link arms of the four-joint linkage may be arranged, when considering the shaver head in its neutral or non-rotated position, in a pitch roof-like or A-configuration where each of the link arms is slightly inclined towards a center plane containing the longitudinal axis of the handle and/or a center plane in the middle between the handle joints of the link arms and extending in parallel to the pivot axis going through such handle joints of the link arms. For example, the elongated link arms, with their longitudinal axis, may extend at an acute angle ranging from 5° to 45° or from 10° to 25° to such center plane, whereas, however, other configurations are possible.

According to another aspect, the distance between the handle joints of the link arms may be larger than the distance between the head joints of the link arms, wherein the difference in the distances can be chosen differently. For example, the distance between the handle joints may be in the range from 105% to 200% or from 120% to 150% of the distance between the head joints, wherein, however, such difference in distances may vary with the length of the link arms.

Irrespective of the difference in distances between the handle points and head points of the link arms, the length of the link arms may be chosen rather short so as to allow for a compact arrangement of the shaver head relative to the handle. In particular, so as to combine a compact arrangement with a high stability of the support structure, the link arms each may have a length that is shorter than the distance between the handle joints of the link arms and/or shorter than the distance between the head joints of the link arms.

These and other features become more apparent from the examples shown in the drawings. As can be seen from FIG. 1, shaver 1 may have a shaver housing forming a handle 2 for holding the shaver, said handle may have different shapes such as a substantially cylindrical shape or box shape or bone shape allowing for ergonomically grabbing and holding the shaver, wherein such shaver handle 2 has a longitudinal axis 20 due to the elongated shape of the handle, cf. FIG. 1.

On one end of the handle 2, a shaver head 3 is attached to the handle 2, wherein the shaver head 3 may be slewably supported about a swiveling axis 7 and about a tilting axis 11 which swiveling and tilting axes 7 and 11 may extend substantially perpendicular to each other and perpendicular to the aforementioned longitudinal handle axis 20.

When considering a main axis 40 of the shaver head 3, the swivel axis 7 may extend parallel to such main axis 40, whereas the tilting axis 11 may extend perpendicular to such main axis 40. Such main axis 40 may be considered to extend in parallel to the larger side surfaces 55 and 57 of the shaver head 3 and/or in parallel with a longitudinal axis of the elongated cutter elements 4 and/or substantially perpendicular to the longitudinal handle axis 20. As can be seen from FIG. 1, the shaver head 3 may have a substantially rectangular box-like shape with a pair of larger side surfaces 55 and 57 arranged on opposite sides of the functional surface 56 which is facing away from handle 2. The shaver head 3 further has two smaller side surfaces 58 and 59 neighboring the aforementioned larger side surfaces 55 and 57 and the functional surface 56.

The shaver head 3 may include a pair of elongated cutter units 100 each comprising an elongated cutter element 4 that can be driven in a reciprocating manner along reciprocating axis 8 which may extend parallel to the aforementioned main axis 40. Said cutter elements 4 may cooperate with and reciprocate under shear foils 5 covering said cutter elements 4.

The said cutter elements 4 may be supported movably relative to the shaver head 3 or, more particularly, relative to a shaver head frame 6 such that, on the one hand, the cutter elements 4 may swivel and tilt together with the shaver head 3 about swiveling and tilting axes 7 and 11 and, on the other hand, the cutter elements 4 may oscillate along a cutting or reciprocating axis 8 relative to the shaver head frame 6, wherein said reciprocating axis 8 may extend parallel to the longitudinal axis of the elongated cutter elements 4. In addition to these degrees of freedom, the cutter elements 4 may be movable relative to the shaver head frame 6 along and/or about additional axes. For example, the cutter elements 4 may dive into the shaver head 3, i.e. displaced along an axis substantially parallel to the longitudinal handle axis 20 when the shaver head 3 is in a position aligned therewith.

The shaver head 3 may include further functional elements such as a long hair cutter which may be arranged between the aforementioned pair of cutter elements 4 or along a side thereof. In addition to or in the alternative to the aforementioned elongated cutter elements 4 oscillating linearly, it also would be possible to provide for cutter elements of the rotatory type which may rotate or rotatorily oscillate.

Figure 2A:
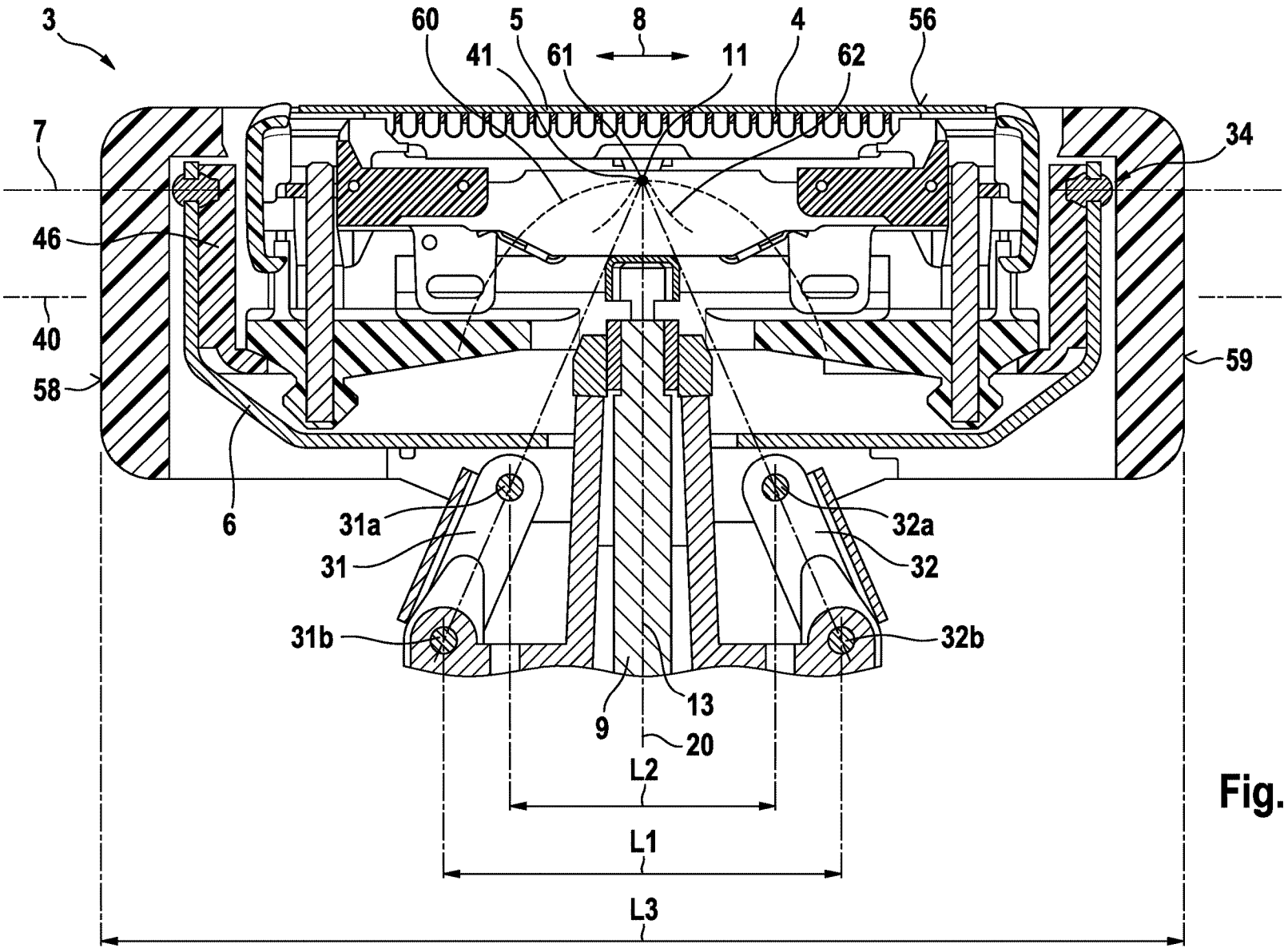
FIG. 2*a*: a cross-sectional view of the shaver head and the support structure thereof, wherein partial view shows the shaver head in a neutral or not tilted position with the link arms of the support structure being symmetrical to and slightly inclined to a middle plane containing the longitudinal axis of the shaver.
Figure 2B:
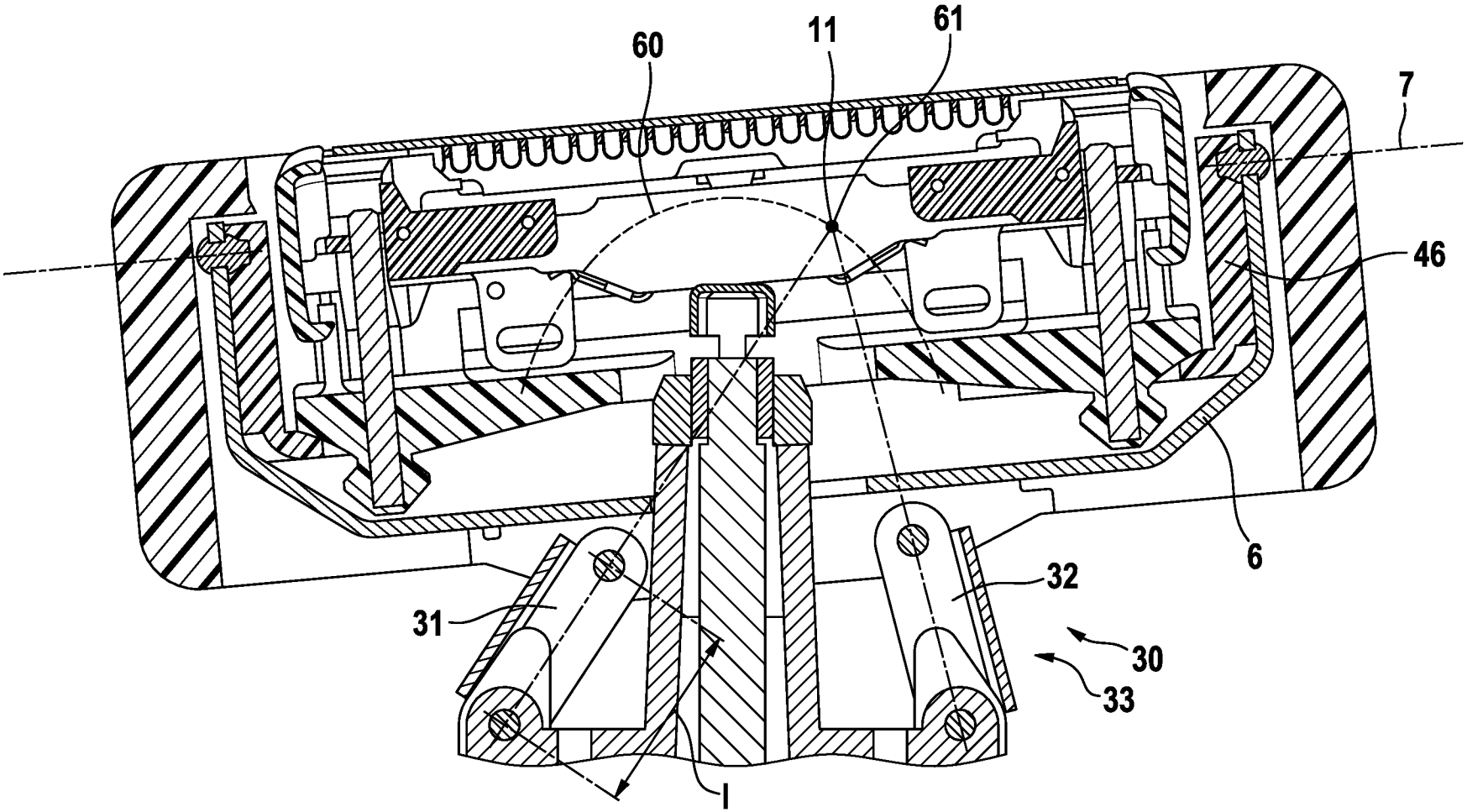
FIG. 2*b*: a cross-sectional view of the shaver head and the support structure thereof, wherein the partial view shows the shaver head in a tilted position with the link arms being pivoted and the shaver head, with a left side, lowered towards the handle, wherein both partial views show the shaver head's instantaneous center of rotation and the polhode thereof along which said instantaneous center of rotation moves, and the trajectory of left and right side ends of the cutter elements along which trajectories said left and right side ends move when tilting the shaver head.
Figure 3:
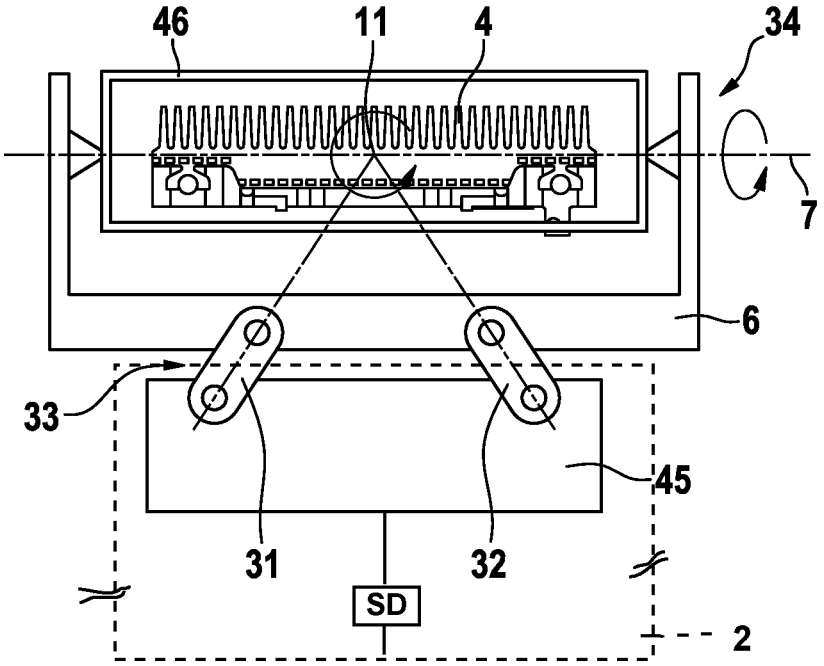
FIG. 3: a more schematic view of the support structure for the shaver head to illustrate the kinematics thereof.
Figure 7:
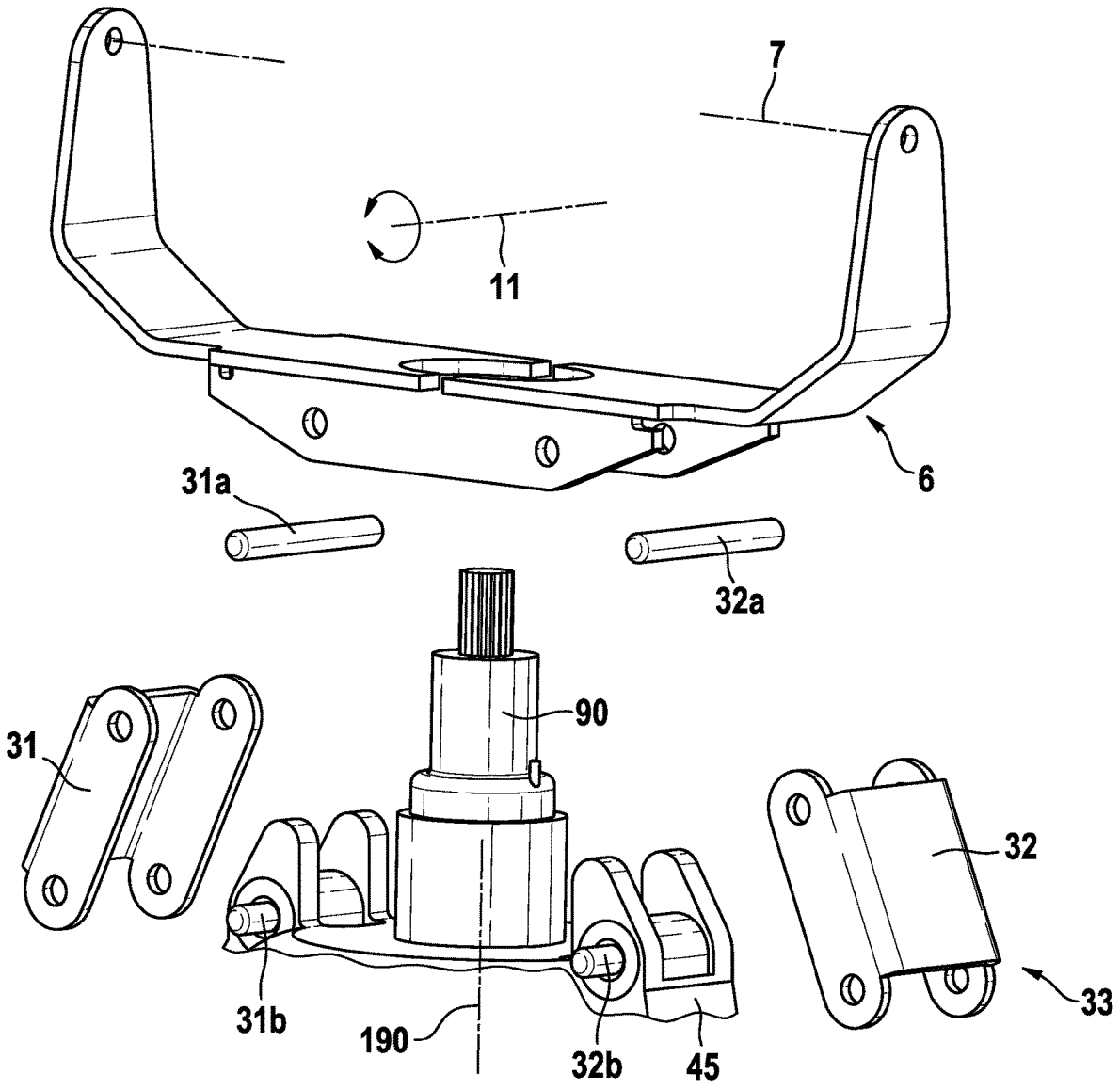
FIG. 7: a perspective explosion view of the four-point linkage of the support structure for the shaver head.

As can be seen from FIGS. 2*a*-2*b* and 3, the shaver head 3 is supported onto the handle 2 by means of a support structure 30 which may include a four-joint linkage 33 which may comprise a pair of link arms 31 and 32 that may pivot about parallel axes. Such link arms 31 and 32 may have a bar-shaped or a frame-like structure including a U-shaped cross-section as it is shown in FIG. 7.

Said link arms 31 and 32 are arranged in an upright, standing configuration where the end portions of those link arms 31 and 32 connected to the shaver head 3 are further away from the handle 2 than the opposite end portions of those link arms 31 and 32 connected to the handle 2 or a base part 45 connected to such handle 2. In other words, when considering the shaver 1 in an upright position with the shaver head 3 above the handle 2, upper end portions of the link arms 31 and 32 are connected to a shaver head part, whereas lower end portions of the link arms 31 and 32 are connected to the handle 2 or a base part mounted thereon.

In a neutral or non-tilted position of the shaver head 3 where the main axis 40 of shaver head 3 extends substantially perpendicular to the longitudinal handle axis 20, the link arms 31 and 32 may be arranged symmetrical with regard to a center plane containing the longitudinal handle axis 20 and extending transverse to the cutter oscillation axis 8, cf. FIG. 2(*a*). More particularly, the link arms 31 and 32 may be inclined relative to such center plane at an acute angle.

As can be seen from FIGS. 2*a*-2*b* and 3, the handle joints 31*b* and 32*b* where the link arms 31 and 32 are pivotably connected to the handle 2 or base part 45 are spaced from each other at a distance L1 that is larger than the distance between the head joints 31*a* and 32*a* where the link arms 31 and 32 are pivotably connected to the shaver head part. The ratio between distance L1 to distance L2 may vary and/or may be adapted to the length of the link arms 31 and 32 so as to achieve the desired kinematics as explained before.

More particularly, the link arms 31 and 32 may be arranged rather close to the aforementioned center plane. For example, said distance L1 of the handle joints 31*b*, 32*b* from each other may be less than 50% or less than 40% of the length L3 of the shaver head 3 measured in the direction of the cutter element's reciprocation axis 8, cf. FIG. 2(*a*).

In addition or in the alternative, a length 1 of said link arms 31, 32 may be chosen rather short to allow for a compact arrangement saving space and easily controllable kinematic of the shaver head 3. More particularly, said length 1 of the link arms 31, 32 may be smaller than the distance L2 of the head joints 31*a*, 32*a* of the link arms 31, 32 from each other and/or may be less than 30% or less than 25% or less than 20% of the length L3 of the shaver head 3 measured in the direction of the cutter element's reciprocation axis 8, cf. FIG. 2*b*. Said length 1 of the link arms corresponds to the distance of the head and handle joints 31*a*, 31*b* or 32*a*, 32*b* of a link arm 31 or 32 from each other wherein both link arms 31, 32 may have the same length 1.

As can be seen from FIG. 2(*a*), a shaver head frame 6 may be connected to the link arms 31 and 32 at the head joints 31*a* and 32*a* thereof which define pivot axes parallel to tilting axis 11. Consequently, the shaver head frame 6 may tilt relative to the handle 2 about said tilting axis 11.

Furthermore, said shaver head frame 6 may pivotably support another shaver head part such as a cutter support frame 46 to allow such cutter support frame 46 to swivel about a swivel axis 7 defined by a pivot bearing 34 between the shaver head frame 6 and the cutter support frame 46. Such pivot bearing 34 may include a shaft or ball received within a hole or recess or a ball socket, wherein the swivel axis 7 may be fixed relative to the shaver head frame 6.

The aforementioned cutter element 4 may be supported at the cutter support frame 46, wherein the cutter elements 4 may be allowed to execute the aforementioned reciprocating drive movements along reciprocating axis 8 relative to the cutter support frame 46. In addition, the cutter elements 4 may dive relative to such cutter support frame 46 towards the handle 2.

Due to the aforementioned upright configuration of the four-joint linkage 33, the shaver head 3, after tilting thereof, may be brought back into its neutral or non-tilting position by means of a biasing means 70 that urges the shaver head 3 away from the handle 2 and/or away from the base part 45. As can be seen from FIG. 6, such biasing means 70 may include a spring device urging the cutter unit away from the handle 2, wherein such spring may be positioned between the aforementioned cutter unit 100 and a drive train element for driving the cutter element 4 in a reciprocating manner. Thus, said biasing means 70 may fulfill a double function or multiple function including biasing the link arms 31 and 32 and thus, the shaver head 3 into their/its neutral, non-tilting position and allowing the cutter unit 4 to dive and/or float.

In addition or in the alternative to such diving of the cutter elements 4 relative to the shaver head structure, it also would be possible to allow for diving of the entire shaver head 3 including the cutter elements 4. For example, the aforementioned link arms 31 and 32 do not need to be connected directly to the handle 2, but they may be linked to a base part 45 which may be movably supported on the handle 2 to be moved along the longitudinal axis 20 of the handle 2. In other words, the base part 45 pivotably supporting the link arms 31 and 32 and thus the entire shaver head 3 may dive towards the handle 2, wherein a biasing device or spring device SD may be provided between the handle 2 and said base part 45, see FIG. 3, to bias or urge the base part 45 away from handle 2 and/or towards the shaver head 3 so that the shaver head 3 may dive against the biasing or spring force. In the alternative, however, such base part 45 also may be rigidly mounted on the handle 2.

Figure 4:
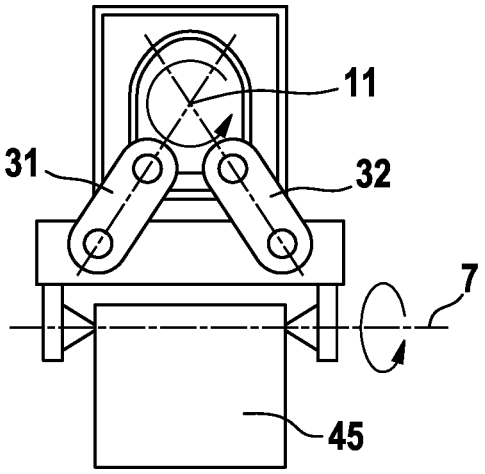
FIG. 4: a schematic view of the support structure for the shaver head according to an alternative aspect where a four-joint linkage for allowing tilting of the shaver head is supported on a swivel part allowing for swiveling of the shaver head.

As can be seen from FIGS. 2*a*-2*b* and 3, the swivel support structure is allowed to execute the tilting movements about tilting axis 11 as the four-joint linkage 33 allowing the tilting movements is arranged between the handle 2 and the swiveling support structure 34. However, as shown by FIG. 4, such order or structure may be reversed so that the four-joint linkage 33 enables swiveling movements. More particularly, a base part 45 may be pivotably supported on the handle 2 to be allowed to swivel about swivel axis 7 relative to handle 2, wherein the link arms 31 and 32 of the four-joint linkage 33, with their handle joints 31*b* and 32*b* may be connected to such swiveling base part 45, cf. FIG. 4.

As shown by FIGS. 2*a*-2*b* and 3, the swivel axis 7 may extend through or very close to the cutter elements 4, wherein said swivel axis 7 may extend between the cutter elements 4 when a pair of cutter elements is provided. For example, the swivel axis 7 may extend in the upper half of the shaver head 3, i.e. the half of the shaver head 3 further away from the handle 2, or may extend in the uppermost quarter of the shaver head 3 or through a top portion of the shaver head 3 where the block-like cutter elements 4 are accommodated.

The tilting axis 11 defined by the four-joint linkage 33 may be positioned closely to the swivel axis 7. More particularly, the tilting axis 11 may move due to the four-joint linkage 33 and the movements of the link arms 31 and 32. As can be seen from FIG. 2(*a*), the intersection of two straight lines one of which goes through the head and handle joints 31*a* and 31*b* of one of the link arms 31 and another one of which goes through the head and handle joints 32*a* and 32*b* of the other one of the link arms 32, defines an instantaneous center of rotation 61 corresponding to tilting axis 11 which may move along a path or polhode 60.

The link arms 31 and 32, in particular the length thereof and the positioning of the head joints and handle joints thereof, can be configured such that said polhode 60 along which the tilting axis 11 in terms of the instantaneous center of rotation 61 may move when considering the limited working range of tilting the shaver head relative to the handle during operation of the shaver, has a curved contour which is convex towards the functional surface 56, wherein such convex curve of the polhode 60 may have a rather shallow contour keeping the instantaneous center of rotation 61 close to the swivel axis 7 even when the shaver head 3 is tilted about tilting axis 11.

As can be seen from FIG. 2(*a*), the link arms 31 and 32 may be configured such that the polhode 60 for tilting axis 11 may entirely extend within shaver head 3, wherein a major portion of such polhode 60 may extend in the upper half of the shaver head 3, i.e. the half of shaver head 3 further away from handle 2. For example, when considering the center point of the polhode 60 for the neutral or untilted shaver head position as shown by FIG. 2(*a*), at least one third of the polhode 60 to the left and one third of the polhode 60 to the right may extend in the upper half of shaver head 3.

The configuration of the link arms 31 and 32 may be chosen to have a virtual center point 41 of the shaver head 3 in the region of the cutter elements 4 move along a trajectory 62 when tilting the shaver head 3 about tilting axis 11, wherein said trajectory 62 may have a pitch roof-like configuration including two trajectory branches diverging from each other towards the handle 2. The aforementioned center point 41 may be considered to be a fixed point of the shaver head part attached to the head joints 31*a*, 32*a* of the link arms 31, 32 in a region around the crossing point of the longitudinal handle axis 20 with the swivel axis 7 in a non-tilted position of the shaver head 3. During operation, this center point 41 during tilting of the shaver head 3, the center point 41 moves along said trajectory 62 the contour of which is defined by the configuration of the four-point linkage 33.

As shown by FIG. 2(*a*), said trajectory 62 may have a convex contour when viewing said trajectory 62 from the functional surface side of shaver head 3, wherein the trajectory 62 may have a central peak from which two trajectory branches go down towards the handle 2. Due to such convex trajectory, also the center point 41 slightly dives when the shaver head 3 tilts.

The kinematics of the shaver head 3 with regard to tilting thereof may provide for good control of contour adaption and improved handling of the shaver. In particular, the shaver head 3 shows an increased stability against tilting when the shaver head 3 is in its neutral or non-tilted position or only slightly tilted, whereas the shaver head is more easily further tilted when it has already been tilted to a certain degree. In other words, the shaver head's willingness to tilt increases with an increasing tilting angle.

Figure 5A:
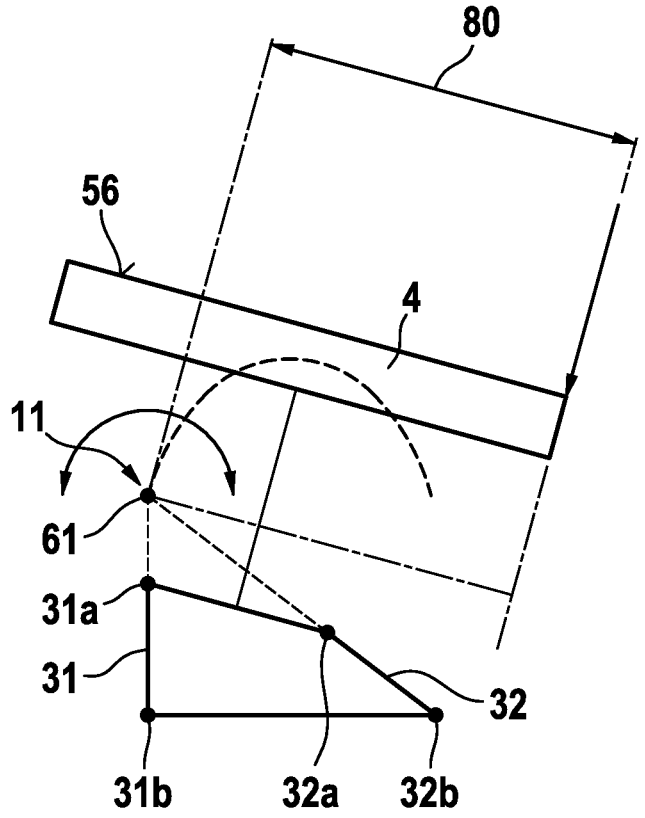
FIG. 5*a*: a schematic view of the position of the instantaneous center of rotation of the shaver head for an already tilted position of the shaver head to illustrate the lever arm of a tilting force and contact pressure, thus showing the willingness of the shaver head to tilt further.
Figure 5B:
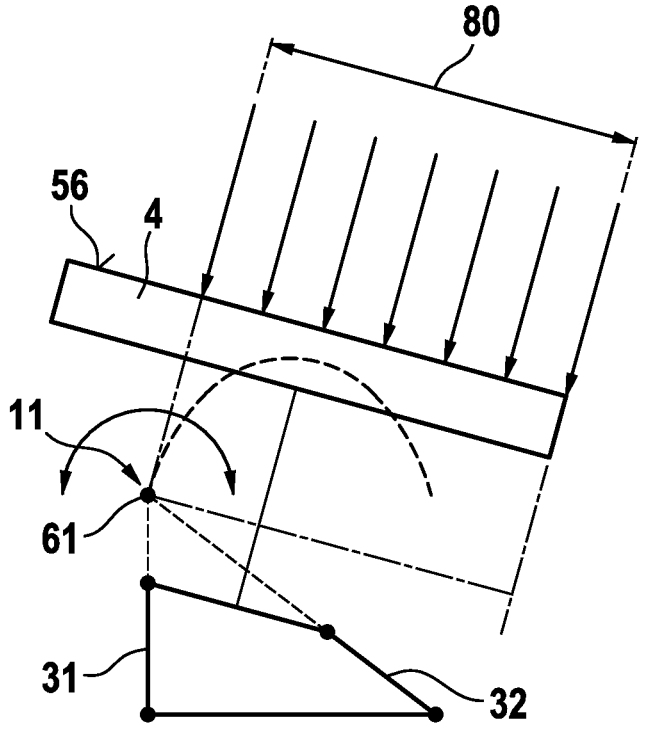
FIG. 5*b*: another view of the shaver head FIG. 5(*a*), with the shaver head tilted showing a contact pressure.

This can be seen from FIGS. 5*a*-5*b* and may be achieved or at least supported by the instantaneous center of rotation defining tilting axis 11 moving away from the end side of shaver head 3 at which end side the shaver head 3 dives towards the handle when tilting. For example, FIG. 5*a* shows a right hand side of shaver head 3 diving due to clockwise tilting. Due to the configuration of the four-joint linkage 33 causing the tilting axis 11, more particularly the instantaneous center of rotation to move towards the left end side of the shaver head 3 along the polhode 60, the lever arm of a contact force urging the shaver head 3 to further tilt, gets a lever arm 80 that increases with an increasing tilting angle. The further shaver head 3 tilts towards the right side, the further the instantaneous center of rotation moves towards the left side what increases the portion of the functional surface 56 on which contact pressure gets a lever arm to further tilt the shaver head 3, cf. partial view (b) of FIG. 5.

Figure 6:
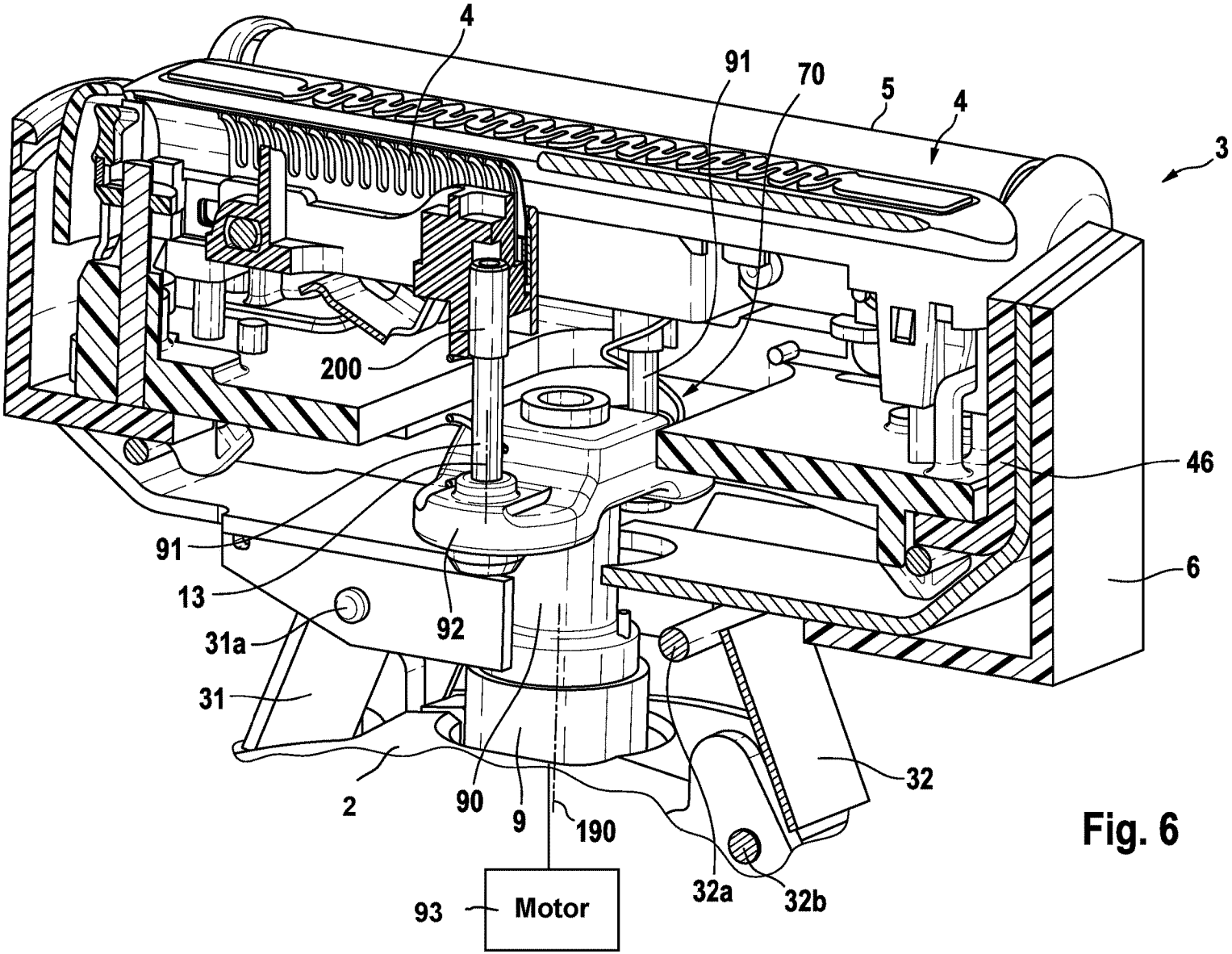
FIG. 6: a perspective cross-sectional view of the shaver head and the support structure thereof, showing the link arms of the four-joint linkage and the drive train extending from the handle through the support structure into the shaver head so as to drive the cutter elements in a reciprocating manner.

As can be seen from FIG. 6, each cutter element 4 can be driven in an oscillating manner by means of an elongated drive transmitter 9 extending from the shaver housing forming the handle 2 into the shaver head 3 up to the cutter element 4. Such elongated drive transmitter 9 may include a rigid shaft 90 extending from the interior of the shaver housing forming the handle 2 to the exterior of the handle 2, that means through the shell of the shaver housing, into shaver head 3, where the drive unit may include a motor 93 accommodated within the shaver housing forming the handle 2 to rotate said shaft 90 in an oscillating manner. Such motor 93 may be a rotatory electric motor connected to the shaft 90 in a suitable manner, for example via a crank mechanism transforming rotation of a motor shaft into rotatory oscillation of shaft 90.

The shaft 90, with its longitudinal or rotatory axis 190, is held in a fixed orientation relative to the shaver housing forming the handle 2, in particular substantially parallel to the longitudinal shaver housing axis 20 or slightly inclined thereto at an acute angle of, for example, 2° to 20° or 5° to 15°.

As can be seen from FIG. 6, the four joint linkage's pivot axes defined by the handle joints 31*b*, 32*b* and the head joints 31*a*, 32*b* extend transverse to said drive shaft 90 on opposite sides thereof. The link arms 31, 32 may be positioned on opposite sides of the drive shaft 90 and may sandwich the aforementioned drive shaft 90 between them.

Although FIG. 2*a* shows only one drive pin 91, it is clear from FIG. 6, that there may be two drive pins 91 when there are two cutter elements 4, such elongated drive pins 91 extending in parallel to each other, cf. FIG. 6, or more than two drive pins 91 when there are more than two cutter elements 4.

The drive pins 91 are each driven by the aforementioned shaft 90 to oscillate uniaxially relative to the shaver head 3 in a direction substantially parallel to the longitudinal extension of the elongated cutter elements 4, cf. FIGS. 4 and 5*a*-5*b*. More particularly, due to the rotatory oscillation of the shaft 90 and the crank arm 92, said drive pins 91 execute an oscillation along a circular path. However, as the crank arm 92 extends in a direction substantially perpendicular to the oscillation axis 8 of the cutter elements 4—at least when considering a neutral or intermediate position of the shaft 90 and crank arm 92 from which the crank arm 92 rotatorily oscillates into opposite directions back and forth—, the segment of the circular path along which the drive pins 91 oscillate is oriented tangential to the oscillation axis 8. As the amplitude of the rotatory oscillation is limited, said segment of the circular path may be considered almost parallel to the oscillation axis 8 and/or almost linear and parallel to the oscillation axis 8.

The entire drive transmitter 9 including the shaft 90 and drive pins 91 may extend from the handle 2 into the cutter element 4 so that the projecting end of the elongated drive transmitter 9 in terms of its drive pin 91 extends within an interior space provided in the cutter element 4.

Said entire drive transmitter 9 including the shaft 90, the crank element 92 and the drive pins 91 form a rigid structure which is rotatably, but otherwise rigidly supported so that the longitudinal axis 13 defined by each drive pin 91 extends in a fixed orientation relative to the handle 2, cf. FIGS. 2*a* and 6. Such longitudinal axis 13 may be substantially parallel to the handle's longitudinal axis 20 or inclined thereto at an acute angle.

As can be seen from FIG. 6, the drive pin 91 of elongated drive transmitter 9 is coupled to the cutter element 4 by means of a joint engaging with the cutter element 4.

The afore-mentioned swivel axis 7 and said tilting axis 11 may extend in or immediately adjacent to a virtual plane containing a connection point 200 connecting the cutter element 4 to said drive transmitter 9, cf. FIG. 6, said virtual plane extending substantially perpendicular to the longitudinal axis 190 of the drive shaft 90.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. An electric shaver comprising:

a. a handle, b. a shaver head including at least one cutter unit which includes a drivable cutter element and a shear foil, c. and a motor connected to said cutter element via a drive transmitter, wherein said drive transmitter comprises a drive shaft extending from said handle into said shaver head, said drive shaft comprising a longitudinal axis, is rotatable in an oscillating manner by said motor and is rotatable about the longitudinal axis, but otherwise is fixedly supported by said handle, d. wherein said shaver head is connected to said handle by a support structure providing for swivel and tilting axes about which said shaver head may swivel or tilt relative to said handle, said swivel and tilting axes extending adjacent to each other and adjacent to said cutter element in directions transverse to each other, e. wherein said support structure includes a pair of link arms forming a four-joint linkage with each link arm having a head joint connected to a shaver head part and a handle joint connected to the handle or a base part, an instantaneous center of rotation along which the tilting axis moves is defined by the intersection of a straight line extending through the head and handle joints of one link arm with a straight line extending through the head and handle joints of another link arm, f. wherein said link arms are mounted in a standing configuration with the head joints of the link arms further away from the handle than the handle joints of the link arms, g. characterized in that said link arms are configured to define for a virtual center point of the shaver head a trajectory having a double pitch roof configuration comprising two branches diverging from each other towards the handle, h. wherein said virtual center point is defined by a point on the shaver head part and positioned in the region of the cutter element in the center thereof.

2. The electric shaver according to claim 1, wherein said two branches of the trajectory extend from a peak point of the trajectory at an acute angle to a center plane going through said peak point and being parallel to a longitudinal axis of the handle, wherein the trajectory extends from said center plane by less than about +/−15% of the length of the shaver head in a direction perpendicular to said center plane.

3. The electric shaver according to claim 1, wherein said link arms are configured such that a direction of a force acting onto a functional side of the shaver head to be contacted with the skin to be shaved, for tilting said shaver head is the same as a direction of a major tilting movement component of the shaver head at a point of the shaver head defined by an axis which is perpendicular to the tilting axis and which crosses said shaver head's functional side.

4. The electric shaver according to claim 1, wherein said instantaneous center of rotation moves along a path extending through and adjacent to said cutter element and having a curved shape which, when considering a working range of rotation of the shaver head, is convex towards a functional side of the shaver head to be contacted with the skin to be shaved, wherein said instantaneous center of rotation of the shaver head is moving further away from a diving side of the shaver head on which diving side the shaver head dives towards the handle when rotating about the tilting axis defined by the link arms.

5. The electric shaver according to claim 4, wherein said path extends entirely in a hemisphere extending from a swivel axis of the shaver head towards the handle, said swivel axis extending transverse to the tilting axis and transverse to the longitudinal axis of the handle.

6. The electric shaver according to claim 1, wherein said motor is received in said handle on a side of the handle joints opposite to the shaver head, wherein the four joint linkage's pivot axes defined by the handle joints and the head joints extend transverse to said drive shaft on opposite sides thereof.

7. The electric shaver according to claim 6, wherein said link arms provide for said tilting axis extending transverse to said drive shaft's rotatory axis and transverse to a reciprocating axis of the cutter element.

8. The electric shaver according to claim 6, wherein said drive transmitter further includes a crank element rigidly connected to said drive shaft and a drive pin which is rigidly connected to said crank element and in driving engagement with said cutter element, wherein the drive pin's longitudinal axis is substantially parallel to a longitudinal axis of said handle, wherein said drive pin's longitudinal axis extends transverse to a reciprocating axis of said cutter element.

9. The electric shaver according to claim 6, wherein said drive shaft includes a rotary axis, the rotatory axis extends parallel to the handle's longitudinal axis or the rotary axis extends at an acute angle of less than about 30° to said handle's longitudinal axis.

10. The electric shaver according to claim 1, wherein said link arms, in a neutral or intermediate position of the shaver head, are arranged in a double pitch roof-like configuration with a distance (L1) of the handle joints of the link arms from each other being larger than a distance (L2) of the head joints of the link arms from each other, wherein said distance (L1) of the handle joints from each other is less than about 50% of the length (L3) of the shaver head measured in the direction of the cutter element's reciprocating axis.

11. The electric shaver according to claim 1, wherein a length of said link arms is smaller than a distance (L2) of the head joints of the link arms from each other.

12. The electric shaver according to claim 1, wherein the swivel axis is generally parallel to a functional surface of said cutter element, said swivel axis extending transverse to a longitudinal axis of the handle and substantially parallel to a reciprocating axis of the cutter element, wherein said swivel axis allows for swiveling of the cutter element relative to a shaver head frame which is tiltable about the tilting axis relative to the handle, wherein said swivel axis is formed by a pivot bearing.

13. The electric shaver according to claim 1, wherein biasing means comprising a spring device is provided for biasing the shaver head away from the handle and away from the base part, thereby biasing the shaver head into a neutral position of the link arms and allowing for floating of the cutter unit.

14. The electric shaver according to claim 1, wherein said pair of link arms, with their handle joints, are connected to the base part which is movably supported onto the handle to allow diving of the entire support structure towards the handle along the longitudinal axis of the handle, wherein a biasing device or spring device is provided for biasing or urging the base part away from the handle.

15. The electric shaver according to claim 1, wherein said swivel axis and said tilting axis extend into a virtual plane extending perpendicular to the drive shaft and into which a connection point connecting the cutter element to said drive transmitter for driving the cutter element extends.

16. The electric shaver according to claim 1, wherein said instantaneous center of rotation moves along a path extending to or across said swivel axis.

17. The electric shaver according to claim 1, wherein the shaft, with its longitudinal axis, is held in a fixed orientation relative to said handle.

* * * * *